US006401576B1

(12) United States Patent
Wu

(10) Patent No.: US 6,401,576 B1
(45) Date of Patent: Jun. 11, 2002

(54) HAND TOOL

(76) Inventor: Fu-Hsiung Wu, No. 23, Lane 175, Tai-Yuan Rd., Taipei (TW)

( * ) Notice: Subject to any disclaimer, the term of this patent is extended or adjusted under 35 U.S.C. 154(b) by 0 days.

(21) Appl. No.: 09/768,064

(22) Filed: Jan. 24, 2001

(51) Int. Cl.[7] ..... B25B 23/16
(52) U.S. Cl. ..... 81/177.4; 81/177.8
(58) Field of Search ..... 81/177.4, 177.5, 81/177.6, 177.8, 489

(56) References Cited

U.S. PATENT DOCUMENTS 839,477 A * 12/1906 Heller ..... 81/177.2
1,034,383 A * 7/1912 Bronson ..... 81/185
2,870,809 A * 1/1959 Feldman et al. ..... 81/489
5,069,091 A * 12/1991 Bramsiepe et al. ..... 81/177.7
5,768,960 A * 6/1998 Archuleta ..... 81/177.8
6,230,593 B1 * 5/2001 Hsieh ..... 81/177.5

* cited by examiner

*Primary Examiner*—Joseph J. Hail, III
*Assistant Examiner*—David B. Thomas
(74) *Attorney, Agent, or Firm*—Rabin & Berdo, P.C.

(57) ABSTRACT

A hand tool provides two operative modes for user selection. The hand tool includes a movable handle which may be turned to a first operative position axially aligned with the shank or be turned normal to the shank at a second operative position so that users may select different handle positions to meet different needs.

12 Claims, 5 Drawing Sheets

HAND TOOL

FIELD OF THE INVENTION

This invention relates to a hand tool for fastening or unfastening screws and nuts such as screwdriver or the like and particularly a hand tool that is capable of functioning in two operative modes.

BACKGROUND OF THE INVENTION

Screws and nuts are the mostly used fastening elements for all kinds of applications nowadays. They can fasten two objects together firmly and securely. However it needs a hand tool such as screwdriver or other automatic power tool (electric or pneumatic tools) to do the job. There are a wide variety of screwdrivers now available in the market place. They mostly includes at least a handle and a shank. The shank has different tips such as cabinet tip, Phillips head tip, plum flower head tip, sleeve head tip and the like for engaging with different types of screw heads.

However most screwdrivers now being used have the handle and shank located at the same axial line. This type of design is not desirable in some occasions (such as to unfasten a very tight screw) as the applicable force is limited. To remedy this problem, there are special screwdrivers being introduced now that have the handle normal to the shank so that they may drive the screw with a greater force. They are specially made for one purpose only and are not suitable for doing the job a conventional screwdriver does. Users have to prepare two different kinds of screwdrivers to make necessary change at the working sites. It is not convenient and costs higher.

SUMMARY OF THE INVENTION

In view of aforesaid disadvantages, it is therefore an object of this invention to provide a hand tool that enables the handle to change to different operation modes.

In one aspect, the hand tool according to this invention includes a shank, a connection member and a handle. The shank is fastened to one end of the connection member. The handle is movably engaged with another end of the connection member. The handle may be turned to a first operative position to align axially with the shank, or be turned to a second operative position normal to the shank. And by means of a locking bolt, the handle may be maintained at the first or second operative position when use. Hence, the user may easily change the handle to either the first or second position according to work requirements.

BRIEF DESCRIPTION OF THE DRAWINGS

The invention, as well as its many advantages, may be further understood by the following detailed description and drawings, in which.

DESCRIPTION OF THE PREFERRED EMBODIMENT

Figure 1:
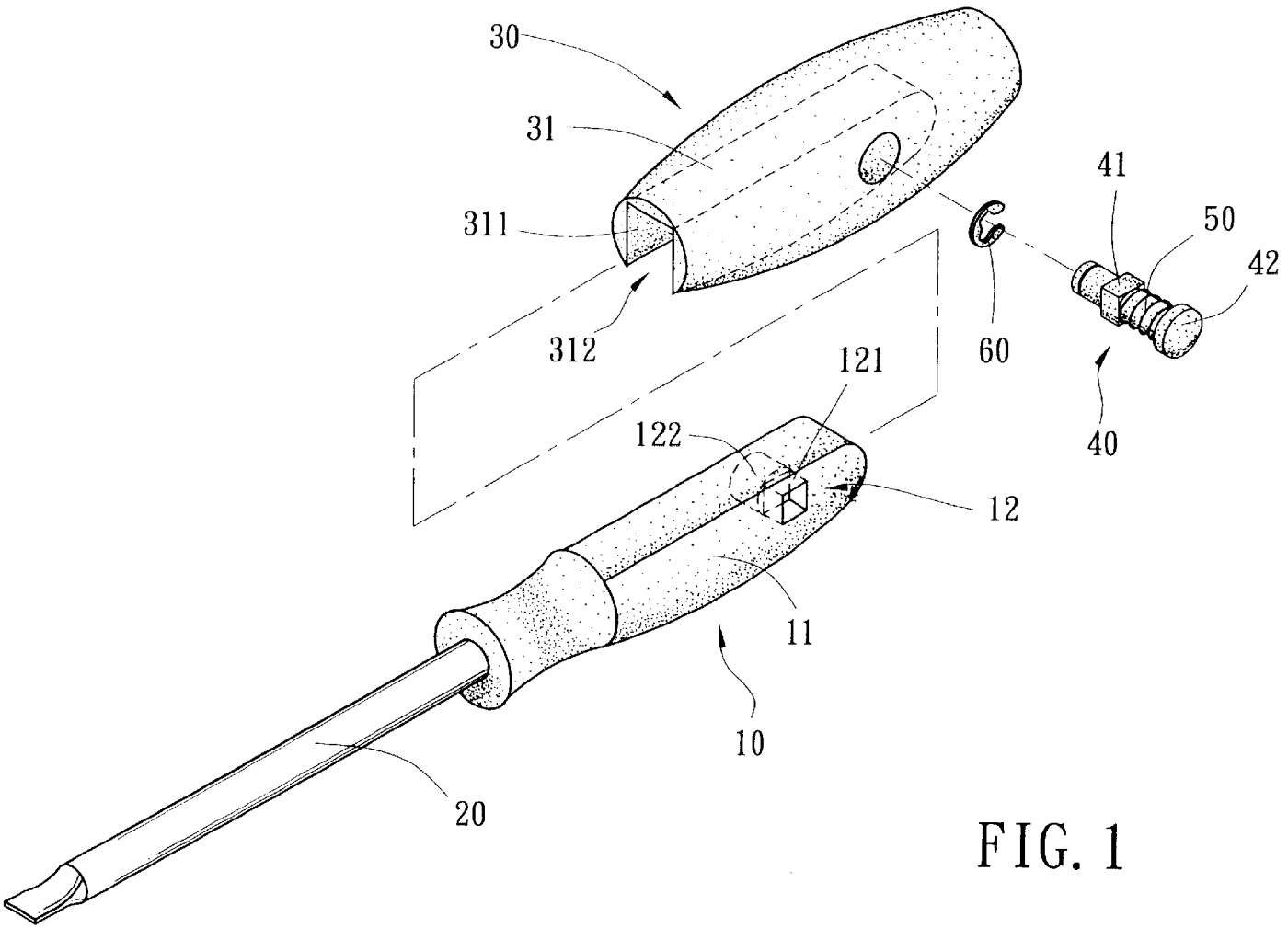
FIG. 1 is an exploded view of this invention.

Referring to FIG. 1, the hand tool according to this invention includes a connection member 10, a shank 20, a handle 30 and a locking bolt 40.

Figure 4:
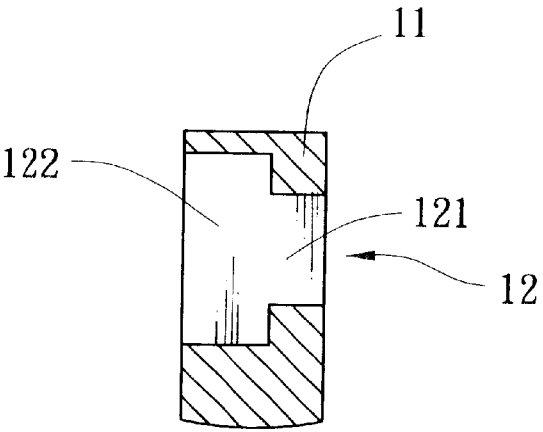
FIG. 4 is a sectional view of the connection member of this invention.

The connection member 10 is substantially formed like a bar having one end engaged with the shank 20. The shank 20 has a tip which may be a slotted insert tip, a Phillips insert tip, a star insert tip, a nut insert tip or the like to suit different screw heads desired (not shown in the figure). The shank 20 may be integrally formed with the connection member 10, or be separated and detachable from the connection member 10 so that different shanks and tips will become changeable as desired. Another end of the connection member 10 opposite to the shank 20 has a pivotal connection section 11 which has a through connection bore 12 which in turn has two ends formed respectively in a square and a circular shape to become a fastening section 121 and a release section 122. The release section 122 has an inner diameter greater than the diagonal length of the fastening section 121 (also shown in FIG. 4).

Figure 5:
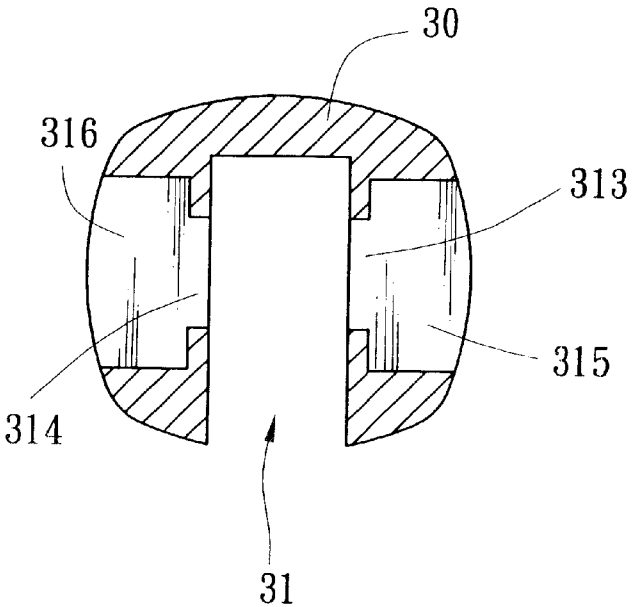
FIG. 5 is a sectional view of the handle of this invention.

The handle 30 is a cylindrical member having one end that opens, via an opening 312, into a holding slot 31. The holding slot 31 may clamp the pivotal connection 11 and has two inner sides 311 which have respectively a fastening hole 313 corresponding to the fastening section 121 and a through hole 314 corresponding to the release section 122. The fastening hole 313 is square and the through hole 314 is circular. The fastening hole 313 extends outward to form a first groove 315 running through the handle 30. The first groove 315 is circular and has an inside diameter greater than the diagonal length of the fastening hole 313. The through hole 314 extends outward to form a second groove 316 running through the handle 30. The second groove 316 is circular and has an inside diameter greater than the inside diameter of the through hole 314 (as shown in FIG. 5).

Figure 6:
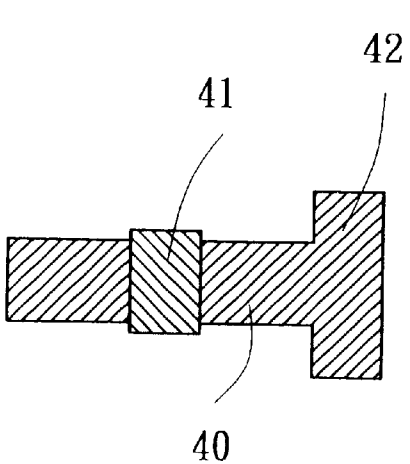
FIG. 6 is a sectional view of the locking bolt of this invention.
Figure 7B:
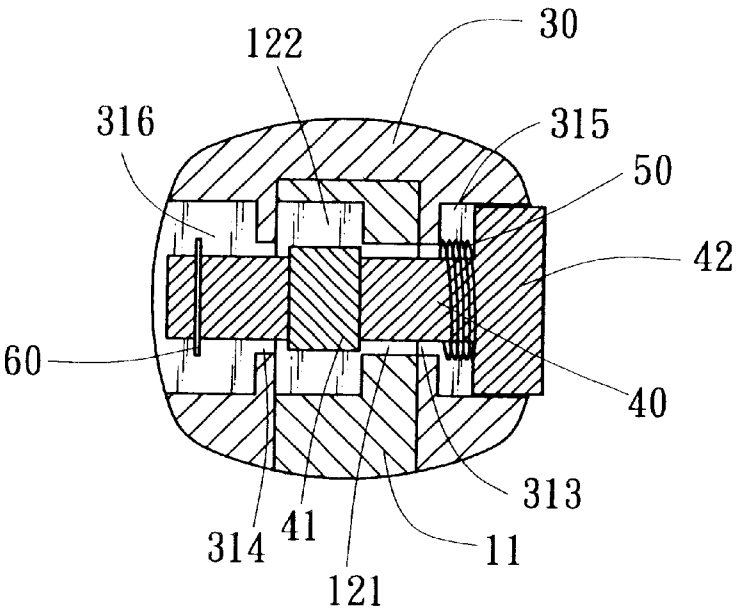
FIG. 7B is another sectional view of this invention.
Figure 7A:
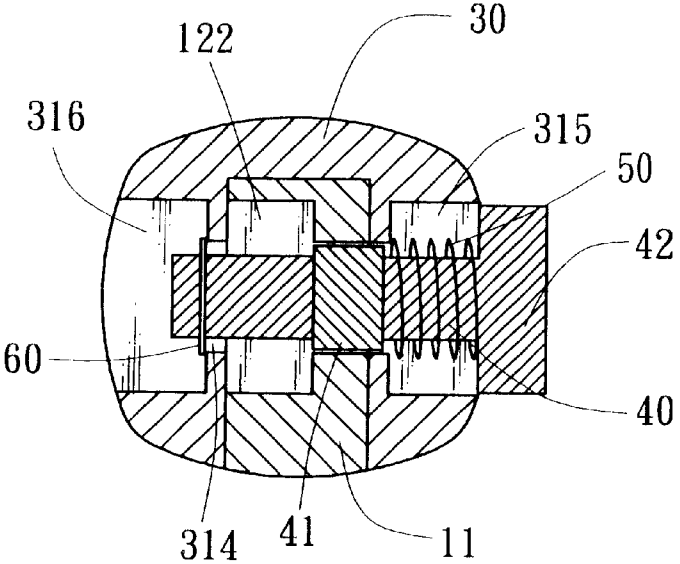
FIG. 7A is a sectional view of this invention.

Referring to FIG. 6, the locking bolt 40 is substantially formed like a round rod and may run through the first groove 315 into the connection bore 12 and further runs though the second groove 316 to enable the handle 30 to pivotally engage with the connection member 10 in a movable manner. At the locking bolt 40, there is a locking block 41 formed at a selected location corresponding to the fastening section 121 and fastening hole 313 and is formed in a square slightly smaller than the fastening section 121 and fastening hole 313. The locking bolt 40 further has a press button 42 located at a position corresponding to the first groove 315. There is an elastic element 50 located between the press button 42 and fastening hole 313. The locking bolt 40 also has a clip washer 60 located at a position corresponding to the second groove 316. The clip washer 60 is slightly larger than the through hole 314 so that it can prevent the locking bolt 40 from dropping out from the handle 30. The elastic element 50 enables the locking block 41 to be positioned between the fastening section 121 and fastening hole 313 to make the handle 30 not movable. This is the lock position of the locking bolt 40. Press the press button 42 downward, the locking bolt 40 will be moved inward to make the locking block 41 moving away from the fastening section 121 and fastening hole 313, and entering into the release section 122. This is the position where the handle 30 is movable in the connection member 10 and is the release position for the locking bolt 40 (shown in FIGS. 7A and 7B).

Figure 2:
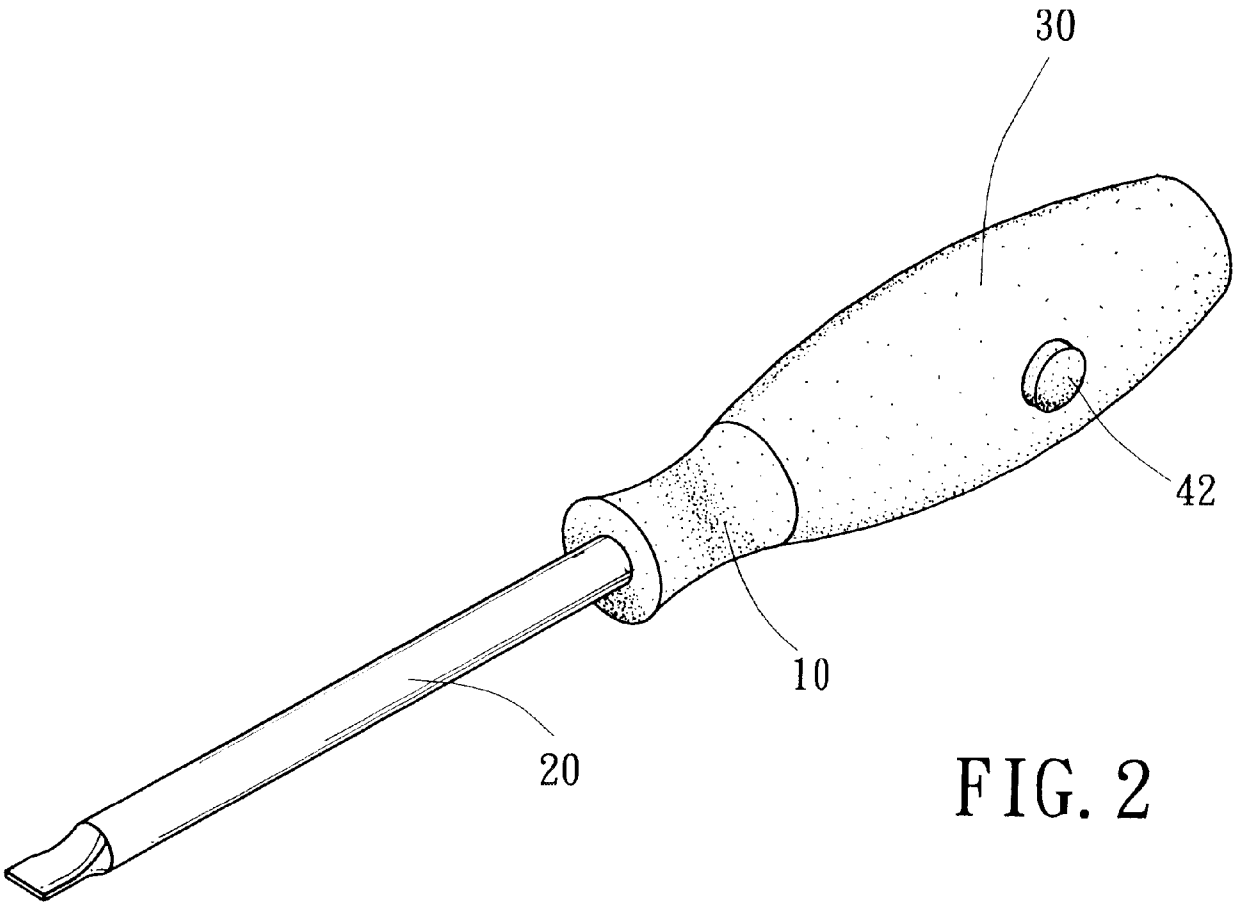
FIG. 2 is a perspective view of this invention, showing the handle at the first operative position.
Figure 3:
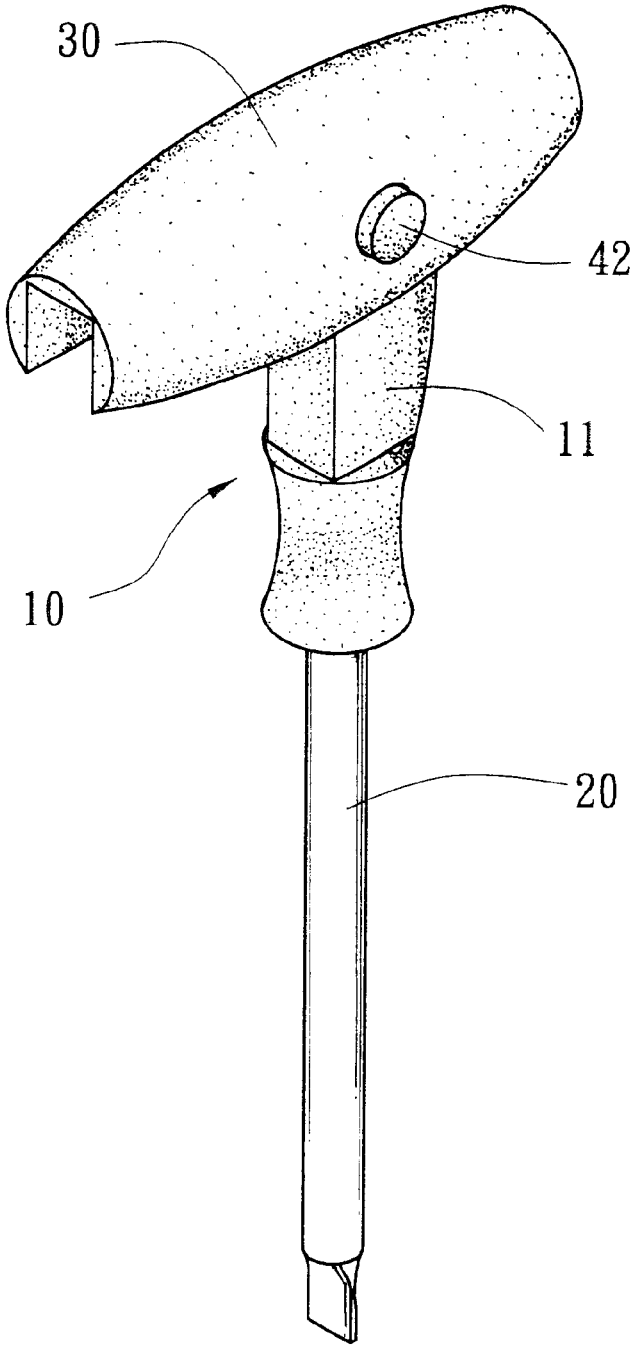
FIG. 3 is a perspective view of this invention, showing the handle at the second operative position.

Referring to FIG. 2, when this invention is in use, the handle 30 and shank 20 may be aligned axially with the handle 30 at a normal state, the locking bolt 40 is at the lock position to keep the handle 30 at the first operative position. When there is a need or desire to change to another operation mode, press the button 42 downward to make the locking block 41 moving away from the fastening section 121 and fastening hole 313 and entering into the release section 122, the locking bolt 40 will be moved to the release position. Then the handle 30 may be turned about the locking bolt 40. As the holding slot 31 has only two adjacent openings 311 and 312, the handle 30 can turn only ninety degree such that the handle 30 will be normal to the shank 20 at the second operative position (as shown in FIG. 3). When the button 42 is released, the elastic element 50 will push the locking block 41 returning to the fastening section 121 and fastening hole 313 at the lock position for the handle 30 be locked again at the second operative position to facilitate operation.

In summary, this invention is capable of offering two different operative positions to meet different working conditions required without the need to acquire two separated hand tools and thus may facilitate operation handily.

It may thus be seen that the objects of the present invention set forth herein, as well as those made apparent from the foregoing description, are efficiently attained. While the preferred embodiment of the invention has been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A hand tool, comprising:

a shank for engaging with screw heads;

a connection member having one end engaged with said shank and another end that defines a pivotal connection section, the pivotal connection section having a bore extending therethrough, one end of the bore having a square shape that forms a fastening section, and another end of bore having a circular shape that forms a release section, the release section, having a diameter that is greater than a diagonal length of the fastening section;

a handle movably engaged with the connection section and being turnable to a first operative position in which the handle is in an axial relationship with the shank and to a second operative position in which the handle is normal to the shank; and a locking bolt engageable with the connection section and extending through the handle, said locking bolt having a locking block engageable with the fastening section of said connection member to keep the handle locked at the first operative position or second operative position, and being positionable in a release position in which the locking block is located in the release section to enable the handle to be moved between the first operative position and the second operative position.

2. The hand tool of claim 1, wherein the shank has a slotted insert tip.

3. The hand tool of claim 1, wherein the shank has a Phillips insert tip.

4. The hand tool of claim 1, wherein the shank has a star insert tip.

5. The hand tool of claim 1, wherein the shank has a nut insert tip.

6. The hand tool of claim 1, wherein the handle has a square fastening hole disposed in alignment with the fastening section of the connection member and a round through hole disposed in alignment with the release section of the connection member, wherein when the handle is locked at the first operative position or second operative position, said locking block is engaged with the fastening section of the connection member and with the square fastening hole of said handle, and when the locking block is in the release position, the locking block is free of engagement with the square fastening hole of said handle.

7. The hand tool of claim 6, wherein the handle has an axially disposed holding slot that receives the pivotal connection section, the holding slot terminating at a distal end of the handle so that the holding slot limits the handle to a ninety degree pivotal movement.

8. The hand tool of claim 6, wherein the fastening hole is in communication with a first groove which extends outward through the handle and which has an inside diameter greater than a diagonal distance of the fastening hole.

9. The hand tool of claim 6, wherein the through hole is in communication with a round second groove which extends outward through the handle and which has an inside diameter greater than an inside diameter of the through hole.

10. The hand tool of claim 1, wherein the locking bolt comprises a round rod having said locking block disposed thereon, and a press button disposed at an end of the round rod; further comprising an elastic element disposed around the rod and being located between the locking block and the press button, wherein the locking block is urged between the fastening section and fastening hole by the elastic element for keeping the locking bolt at a locked position, the press button being pressable for moving the locking block to the release section whereby the locking bolt is at the release position.

11. The hand tool of claim 1, further comprising a clip washer disposed at an end of the locking bolt for preventing the locking bolt from dropping off from the connection member and handle.

12. The hand tool of claim 1, wherein the fastening hole and the through hole are disposed in alignment with each other and on opposite sides of the holding slot.

* * * * *